US006095104A

United States Patent [19]

Bolognesi et al.

[11] Patent Number: 6,095,104

[45] Date of Patent: Aug. 1, 2000

[54] METHOD FOR THE DIMENSION CHECKING OF THE TIMING SYSTEM OF AN ENGINE

[75] Inventors: Antonio Bolognesi, Bologna; Franco Danielli, Zola Predosa; Antonio Ghielmi, Granarolo Emilia, all of Italy

[73] Assignee: Marposs Societa'per Azioni, Italy

[21] Appl. No.: 09/230,092

[22] PCT Filed: Sep. 3, 1997

[86] PCT No.: PCT/EP97/04790

§ 371 Date: Jan. 20, 1999

§ 102(e) Date: Jan. 20, 1999

[87] PCT Pub. No.: WO98/11328

PCT Pub. Date: Mar. 19, 1998

[30] Foreign Application Priority Data

Sep. 16, 1996 [IT] Italy ..... BO96A0460

[51] Int. Cl.[7] ..... F01L 1/20

[52] U.S. Cl. ..... 123/90.31; 123/90.15; 123/90.17; 123/90.52; 123/90.6; 73/118.1; 73/119 R

[58] Field of Search ..... 123/90.15, 90.17, 123/90.31, 90.45, 90.5, 90.6; 73/118.1, 119 R

[56] References Cited

U.S. PATENT DOCUMENTS

| | | | |
|---|---|---|---|
| 3,988,925 | 11/1976 | Seccombe et al. | 73/119 R |
| 4,521,863 | 6/1985 | Solaroli | 364/561 |
| 4,966,107 | 10/1990 | Imajo | 123/90.45 |

FOREIGN PATENT DOCUMENTS

| | | |
|---|---|---|
| 2 509 850 | 1/1983 | France . |
| 2 307 533 | 5/1997 | United Kingdom . |

OTHER PUBLICATIONS

Patent Abstracts of Japan, Kokai No. 57–13205, Jan. 1982.

*Primary Examiner*—Weilun Lo

*Attorney, Agent, or Firm*—Dickstein Shapiro Morin & Oshinsky LLP

[57] ABSTRACT

A method and an associated apparatus for the dimension checking of the timing system of an internal combustion engine, in particular for checking the clearance existing between the cams of the camshaft and the relevant valves in the cylinder head, by dimensional measurements of the cylinder head and the camshaft separately, and processing, in a storing, processing and display unit, the dimensional measurements for evaluating how the camshaft actually positions itself with respect to the cylinder head on which it is mounted, in the course of the normal running of the engine.

12 Claims, 4 Drawing Sheets

METHOD FOR THE DIMENSION CHECKING OF THE TIMING SYSTEM OF AN ENGINE

TECHNICAL FIELD

The invention relates to a method for the dimension checking of the timing system of an internal combustion engine comprising at least a camshaft with cams and main journals, and a cylinder head with valves and seats for housing the main journals and defining the position of the mentioned camshaft in a longitudinal direction, the method including the steps of detecting and processing values relating to diametral dimensions of the main journals of the camshaft and radial dimensions of the cams, detecting and processing values relating to diametral dimensions of the seats of the cylinder head, and the transversal arrangement of the valves with respect to the formerly mentioned longitudinal direction, and calculating—on the basis of the detected values and in the course of the camshaft rotation—a clearance value between each cam and its associated valve. The invention also relates to an apparatus for checking the timing system of an internal combustion engine according to the formerly mentioned method.

BACKGROUND ART

There are known internal combustion engines with mechanical tappet comprising elements commonly called "bucket type tappets" positioned between the cylinder head valves and the associated cams of the camshaft and having the purpose of remaining in contact with the valves and cooperating with the cams lobes in the course of the camshaft rotation. In order to ensure a correct performance in the valve opening and closure phases, it is necessary that the clearance existing between the base circle of each cam and the related bucket type tappet be determined in an accurate way.

In fact, if on the one hand no clearance, or an extremely limited amount of clearance, would not allow the proper closure of the valves, on the other hand an excessive clearance would detrimentally affect the performance and the life of the engine and, among other things, increase noise.

In order to attain, for each single cam/bucket type tappet coupling the required amount of clearance, generally there is foreseen the insertion—in a suitable bucket type tappet recess, at the cam or valve side—of a specifically thick adjustment shim so that the clearance between the base circle of the cam and the bucket type tappet (or the shim) be of the desired value. According to a variant, that does not involve the insertion of shims, there can be foreseen, for each cam/valve coupling, the selection of an appropriate bucket type tappet among a series of bucket type tappets that have different predetermined thicknesses. The English abstract of Japanese patent application JP-A-57013205 shows a device for calculating the gaps existing between the top faces of the valve lifters 3 and the base circles of the relevant cams of a camshaft when the latter is assembled to the cylinder head. The thickness of the shims to be inserted are chosen on the basis of the values of the calculated gaps and of the desired clearances. Two measurements are taken to calculate each gap. A first measurement is taken on the cylinder head, substantially corresponding to the distance between the top surface of each bucket type valve lifter and a camshaft bearing surface 9 of the cylinder head. A second measurement is taken on the camshaft, corresponding to the distance between the surfaces of the base circle of the cam and a bearing journal of the camshaft.

The calculations for determining the thickness of the adjustment shims, or that of the bucket type tappets, are troublesome due to various reasons among which the radial clearance existing between the main journals of the camshaft and the cylindrical seats of the cylinder head in which these journals are seated. This clearance is limited, but necessary for guaranteeing a correct rotation of the camshaft and allowing an appropriate lubrication. Devices like the one shown in the English abstract of JP-A-57013205 do not take into account such radial clearance in the calculation of the gaps.

A checking method presently used for determining the thicknesses foresees the use of apparatuses that check the dimensions of the cylinder head and those of the camshaft separately (as shown in the above cited English abstract) and the processing of the results thus obtained by supposing that, in the course of the running of the engine and the rotating of the camshaft, the main journals of the latter—urged by the thrust of the valve springs alternatively compressed by the various cams—are in constant contact with the associated cylindrical seats, at diametrally opposite positions with respect to the valves. This assumption is an approximation that depends, among other things, on the number and the angular position of the cams on the camshaft and does not guarantee highly reliable results.

In order to improve the method reliability, the results can be compensated in an empiric way, on the basis of statistics on errors detected in the course of subsequent checkings, for example when the selected shims (or the bucket type tappets) have been inserted and the camshaft is mounted in the cylinder head. In any case, this is not a really practical method of operating, since there is the need to collect an enormous amount of data and process them in an appropriate way, hence involves a considerable amount of time, high costs and not always achieves satisfying results.

DISCLOSURE OF THE INVENTION

Object of the present invention is to provide a method for determining the thickness of plates, or shims, to be inserted in the bucket type tappets, or the thickness of the bucket type tappets, that is particularly accurate and reliable and enables to overcome the disadvantages of the known methods.

A further object is to provide a checking apparatus that enables to implement this method in a simple and effective way. These objects are achieved by a method and a checking apparatus according to the present invention.

A method and a checking apparatus according to the invention provide the main result of determining, in an extremely accurate and reliable way, the thickness of the individual shims, or of the bucket type tappets, coupled to the valves, consequently attaining an extremely high accuracy in implementing the desired clearance between the base circle of each cam and the associated valve.

A further advantage, that the method according to the present invention provides, is the application flexibility, in other terms the possibility of attaining particularly reliable results, no matter what the shape of the camshaft and that of the associated cylinder head—that undergo the checking—be.

BRIEF DESCRIPTION OF THE DRAWINGS

The invention is now described in more detail with reference to the enclosed sheets of drawings, given by way of non limiting example, wherein.

BEST MODE FOR CARRYING OUT THE INVENTION

The figures numbered 1, 2 and 3 illustrate checking stations that are part of an apparatus for implementing the method according to the invention. More particularly, FIGS. 1, 2 and 3 show—in an extremely schematic and incomplete way—devices for the dimension checking of elements of the timing system of an engine while leaving out of account, for the sake of simplicity, some known structural details of the checking systems.

Figure 1:
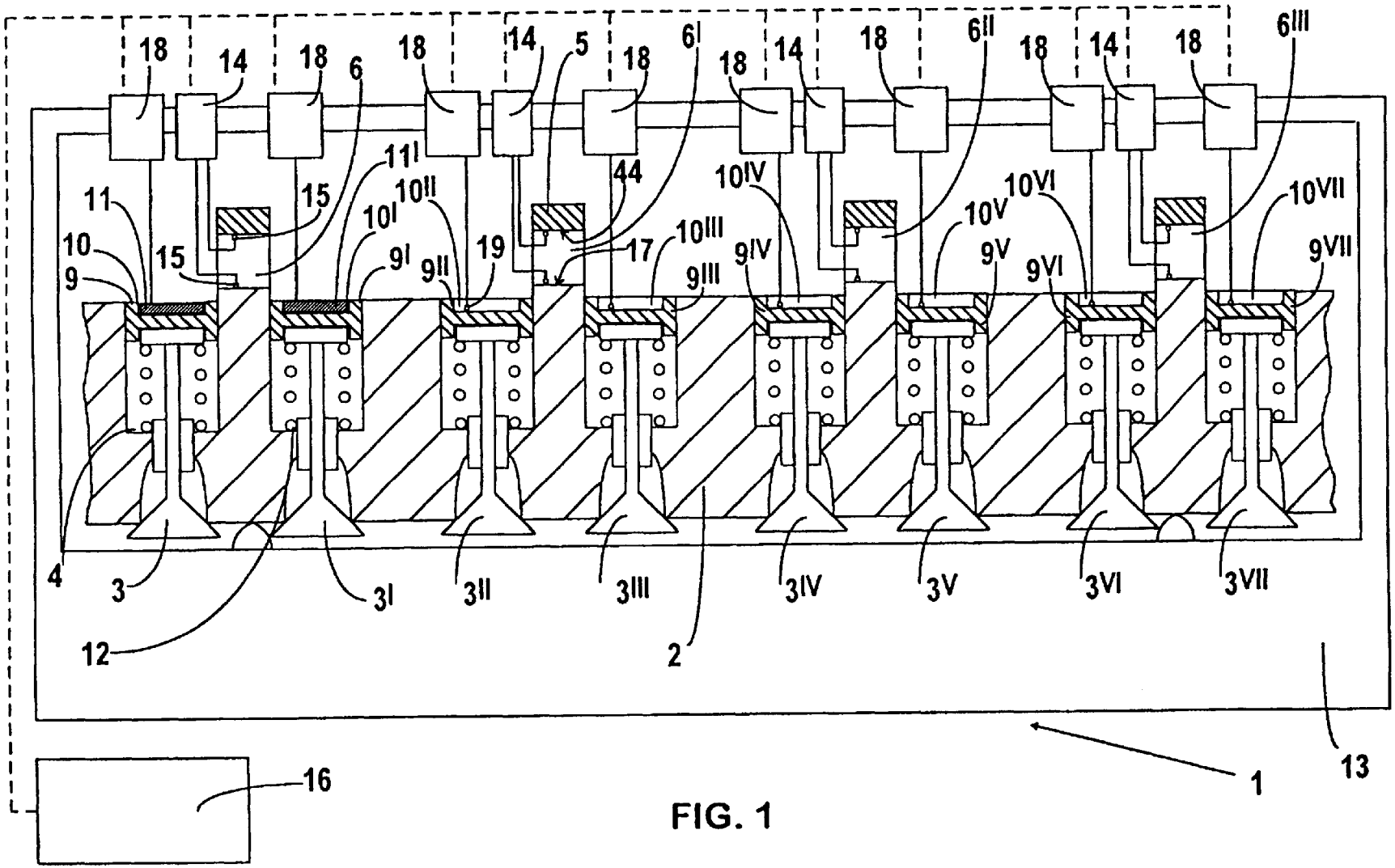
FIG. 1 schematically shows a first checking station for checking the cylinder head of an internal combustion engine, FIG. 2 schematically illustrates a second checking station for dimension checking on a camshaft, FIG. 3 schematically shows the arrangement of the camshaft in the cylinder head, and emphasizes the camshaft deformation by way of a broken line, with segments representing the portions comprised between the cross-section centers of the main journals at the central cross-sections (the deformation undergone by the camshaft and the clearances between journals and seats have been intentionally exaggerated with respect to the actual conditions with the aim of providing clearness)
Figure 2:
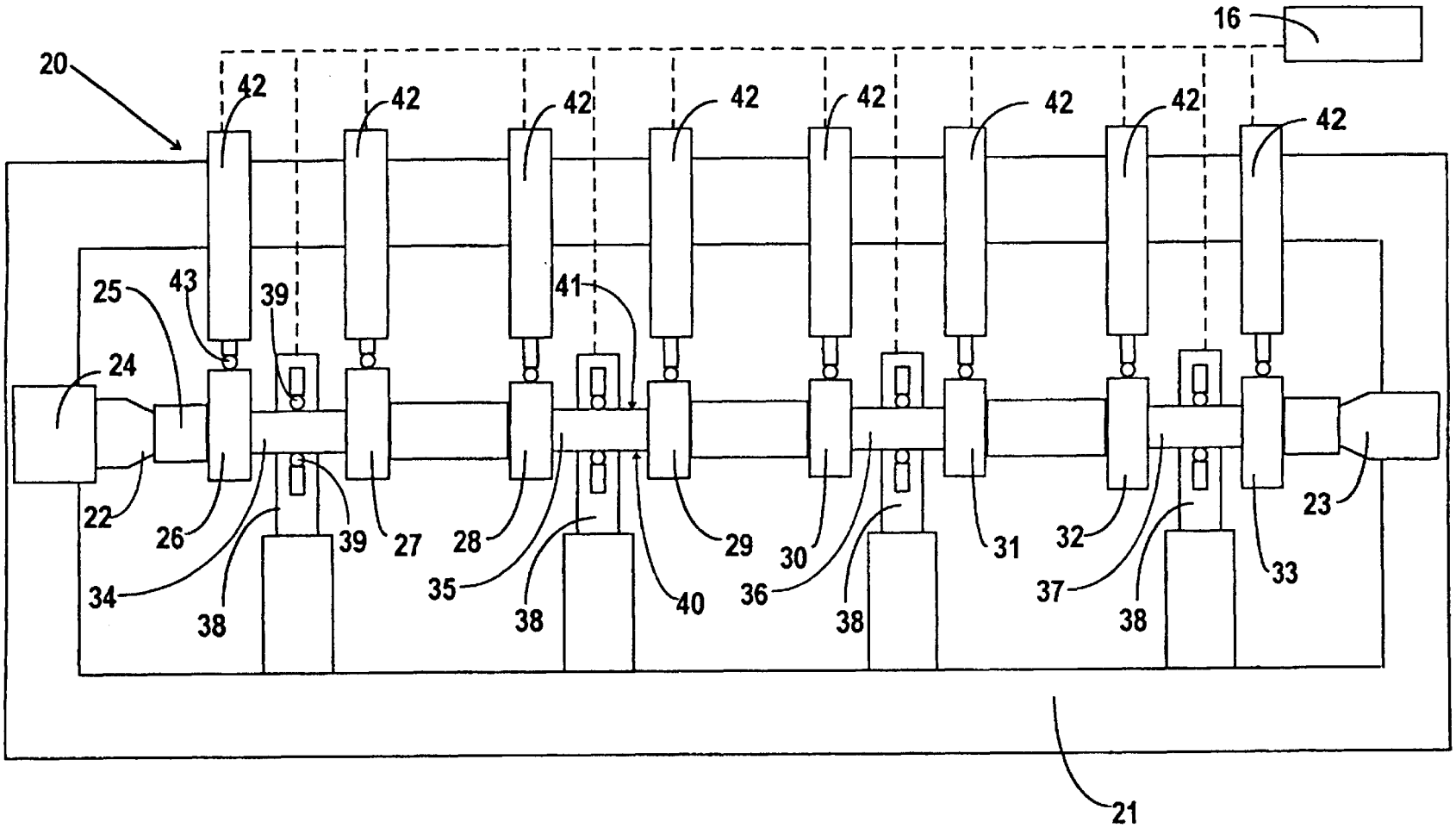
Figure 3:
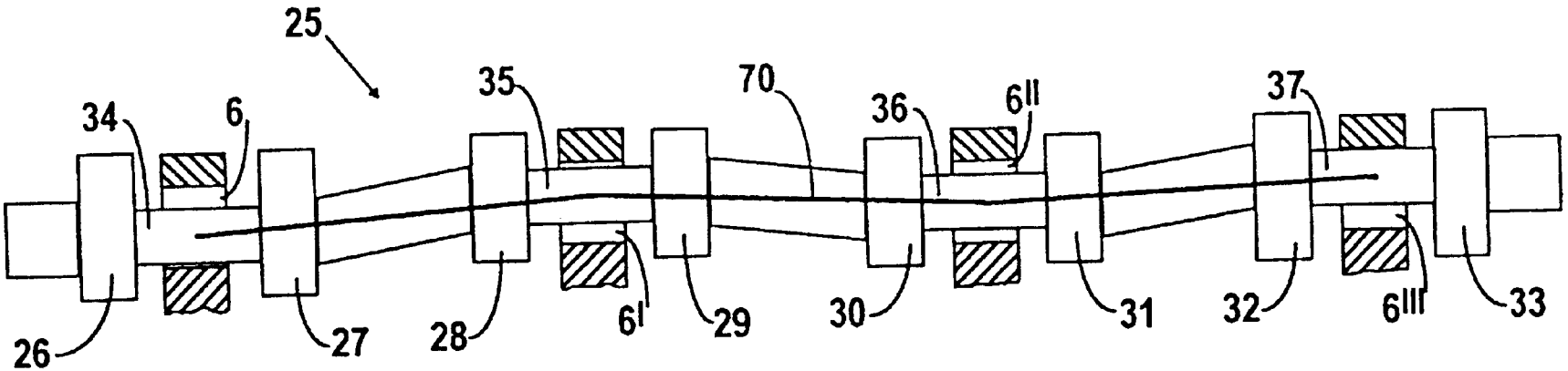

The embodiment referred to in FIGS. 1, 2 and 3 regards elements of the timing system of an internal combustion engine with four cylinders and four valves per cylinder and two substantially identical camshafts 25 (only one has been schematically illustrated in the drawings) comprising eight cams 26, 27, 28, 29, 30, 31, 32 and 33 and four cylindrical portions or main journals 34, 35, 36 and 37. The cams 26–33 are angularly arranged by pairs in four directions spaced at 90° apart, and a main journal is placed between each pair of cams.

In FIG. 1, that refers to a first station 1 for checking a cylinder head 2 of an internal combustion engine, there are shown just some fundamental elements of the cylinder head 2, more specifically, a central body with valves 3, $\mathbf{3}^{I}$, $\mathbf{3}^{II}$, $\mathbf{3}^{III}$, $\mathbf{3}^{IV}$, $\mathbf{3}^{V}$, $\mathbf{3}^{VI}$, $\mathbf{3}^{VII}$ housed in associated openings 4 and caps 5 coupled to the main body in a dismantable way, by means of screws (not shown in the figure). The internal surfaces of the caps 5 define, with corresponding surfaces of the central body of the cylinder head 2, substantially cylindrical seats 6, $\mathbf{6}^{I}$, $\mathbf{6}^{II}$, $\mathbf{6}^{III}$ for housing the main journals 34–37 of the camshaft 25 and supporting and referring the position of the camshaft 25 in the cylinder head 2 in a longitudinal direction. An end of each of the valves 3–$\mathbf{3}^{VII}$—that can displace in reciprocally parallel transversal directions—contacts a bucket type tappet 9, $\mathbf{9}^{I}$, $\mathbf{9}^{II}$, $\mathbf{9}^{III}$, $\mathbf{9}^{IV}$, $\mathbf{9}^{V}$, $\mathbf{9}^{VI}$, $\mathbf{9}^{VII}$ that has a recess 10, $\mathbf{10}^{I}$, $\mathbf{10}^{II}$, $\mathbf{10}^{III}$, $\mathbf{10}^{IV}$, $\mathbf{10}^{V}$, $\mathbf{10}^{VI}$, $\mathbf{10}^{VII}$ for housing an appropriately thick adjustment shim. FIG. 1 depicts, as an example only, just two adjustment shims 11 and $\mathbf{11}^{I}$. Obviously, as will become apparent from the following description, in the course of the checking operation referred to in FIG. 1, shims 11 and $\mathbf{11}^{I}$ are not inserted in recesses 10 and $\mathbf{10}^{I}$. Compression springs 12 are housed in openings 4 and urge valves 3–$\mathbf{3}^{VII}$ towards the exterior of the cylinder head body 2. The first checking station 1 comprises a structure 13 for supporting and referring cylinder head 2 and first detecting means with first gauging heads 14. Each of the gauging heads 14—of a known type—comprises a casing, coupled to structure 13, and a pair of arms movable with respect to the casing, including associated feelers 15 for contacting diametrically opposite points of the seats 6, $\mathbf{6}^{I}$, $\mathbf{6}^{II}$ and $\mathbf{6}^{III}$ at associated transversal, measurement cross-sections. Moreover, the gauging heads 14 comprise known transducer means (not shown in the figures) connected to the movable arms and the casing for sending to a storing, processing and display unit 16 signals responsive to the deviations from the nominal values of the distances of the lower and upper generating lines 17 and 44 of the seats 6, $\mathbf{6}^{I}$, $\mathbf{6}^{II}$, $\mathbf{6}^{III}$, in other terms, the arrangement of these generating lines 17 and 44 with respect to the reference structure 13. Moreover, the first detecting means comprise second gauging heads 18 of known type too, including casings coupled to the structure 13, and movable arms with feelers 19 for cooperating with the bottom surfaces of the recesses 10–$\mathbf{10}^{VII}$ of the bucket type tappets 9–$\mathbf{9}^{VII}$ (FIG. 1 does not show the feelers 19 arranged in the two recesses 10 and $\mathbf{10}^{I}$, but instead—as an example and as hereinbefore previously described—the adjustment shims 11 and $\mathbf{11}^{I}$). In gauging heads 18 there are transducer means (of a known type and not illustrated in the figures) for detecting displacements of the movable arm and providing the storing, processing and display unit 16 with signals responsive to deviations from the nominal values of the arrangement of those surfaces, in other terms the associated transversal positions with respect to the reference structure 13.

FIG. 2 shows a second checking station 20 comprising a second support and reference structure 21, with elements for supporting camshaft 25, comprising a live center 22 and a dead center 23, that define a longitudinal geometrical axis.

A motor 24 is coupled to live center 22 and drives the rotation of camshaft 25 about the formerly mentioned longitudinal geometrical axis.

Second detecting means comprise third gauging heads 38, of a known type, with casings fixed to the support structure 21 and arms—movable with respect to the casing—including feelers 39 for cooperating with the surface of the main journals 34–37 at diametrically, reciprocally opposite points at transversal cross-sections of measurement. There are transducers (not illustrated in the drawings) connected with the movable arms for sending to the storing, processing and display unit 16 signals responsive to the deviations from the nominal values of the distances of the lower and upper generating lines 40 and 41 of the main journals 34–37, in other terms, the associated transversal positions with respect to the support structure 21. The second detecting means also comprise fourth gauging heads 42, of a known type too, with casings fixed to the support structure 21 and movable arms with feeler elements 43 for cooperating with the surface of the cams 26–33. The transducers (not shown in the drawings) are connected with the movable arms for sending to the storing, processing and display unit 16 signals responsive to the deviations from the nominal values of the radial dimensions of the base circles of the cams 26–33.

Figure 4:
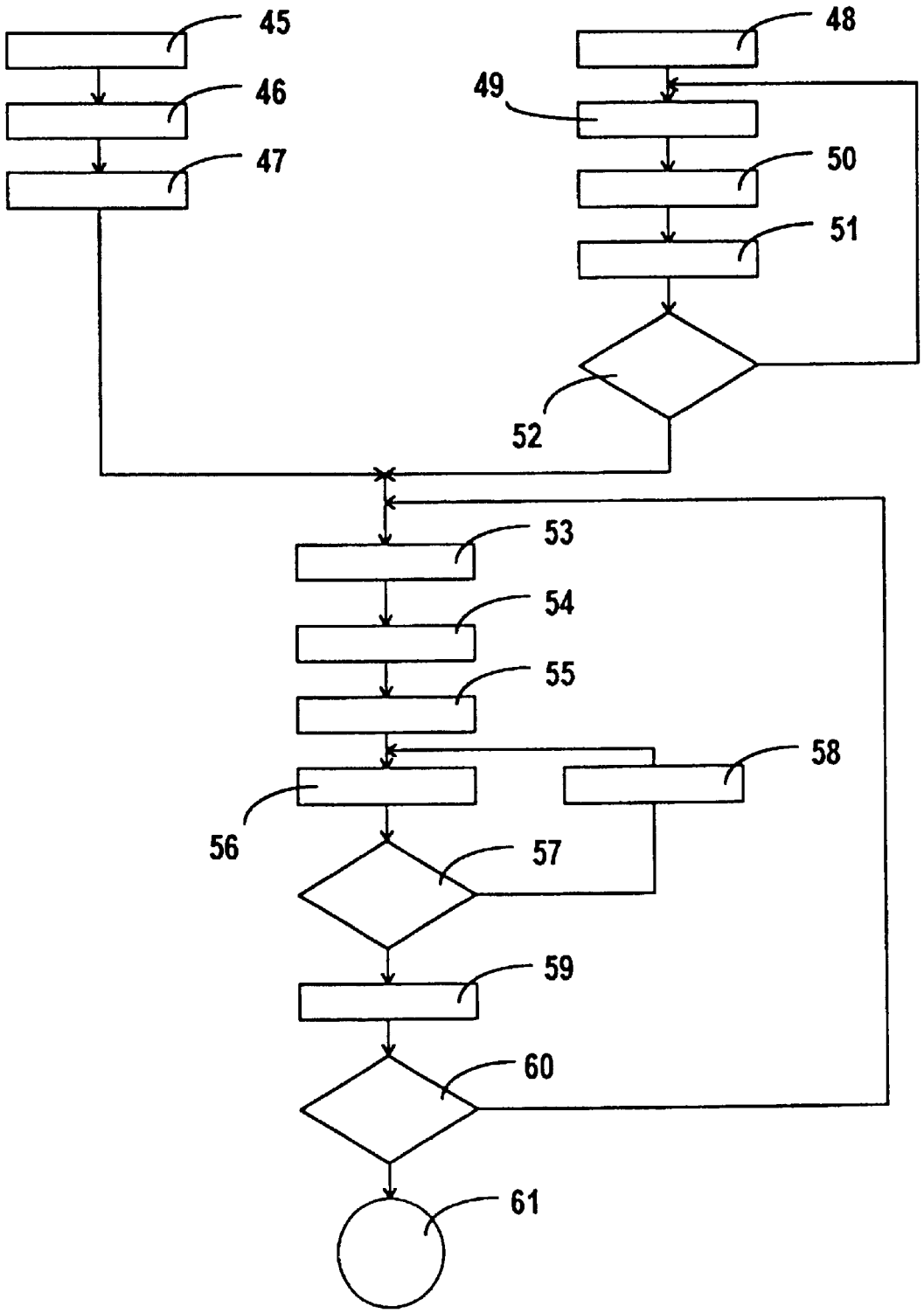
FIG. 4 is a block diagram showing a checking method according to the invention.

In the diagram shown in FIG. 4, the logic blocks identify the different phases of a checking method according to the invention and hereinafter described, and more specifically:

- block 45: positioning of the cylinder head 2 in the first checking station 1;
- block 46: checking the dimensions of the cylinder head 2;
- block 47: processing the detected dimensions relating to cylinder head 2, defining a first reference axis and calculating the dimension values with respect to such axis;
- block 48: positioning of the camshaft 25 in the second checking station 20;
- block 49: positioning of the camshaft 25 in a predetermined angular position;
- block 50: detecting the dimensions of the main journals 34–37 and the radial dimensions of the cams 26–33;

block 51: processing the detected dimensions correlated with camshaft 25, defining a second reference axis and calculating the dimension values with respect to such axis;

block 52: checking the angular positions in which camshaft 25 has undergone measurements in the second station 20, and comparison with a pre-set number of predetermined angular positions (more specifically, four);

block 53: selecting for camshaft 25 an angular position in cylinder head 2 among a certain number of predetermined positions (specifically, four);

block 54: calculating the possibility of displacement of each journal 34–37 in its associated seat 6–6$^{III}$;

block 55: attributing initial deviation values to the seat/journal pairs;

block 56: calculating the elastic energy stored by camshaft 25 at predetermined deviation values;

block 57: checking relating to the calculated elastic energy;

block 58: modifying the deviation values correlated to the seat/journal pairs;

block 59: calculating the gap between a pair of cams in phase and their associated valves, and determining the thicknesses of the associated adjustment shims;

block 60: verifying the number of checkings that have been performed;

block 61: ending of the procedure.

According to the invented method, the first steps to be performed are parallel checkings on cylinder head 2 and camshaft 25 at checking stations 1 and 20, respectively, as hereinafter described. Generally, before these checkings take place, there is a calibrating phase in which identical checkings are performed on master pieces (with nominal reference dimensions) mounted in the two checking stations 1 and 20.

At the first checking station 1 (block 45), the cylinder head 2 is positioned and referred on structure 13 and feelers 15 and 19 contact pairs of points on the internal surfaces of seats 6–6$^{III}$ and the bottom surfaces of the recesses 10–10$^{VII}$ of the bucket type tappets 9–9$^{VII}$, respectively. The first and the second gauging heads 14 and 18 send to unit 16 signals responsive to the arrangement of the lower and upper generating lines 17 and 44 of seats 6–6$^{III}$ and, respectively, of the bottom surfaces of the recesses 10–10$^{III}$ (block 46). These latter signals are indicative of the transversal arrangement of the associated valves 3–3$^{VII}$.

The signals representative of the arrangement of the lower and upper generating lines 17 and 44 of the two end seats 6, 6$^{III}$ are processed by the storing, processing and display unit 16 for defining the position of the cross-section centers of the end seats 6 and 6$^{III}$, in other terms, the position of the axes of these seats, at the transversal cross-sections of measurement, and determining a first longitudinal, reference axis passing through those centers (block 47). Hence, further processings are carried out for referring the detected dimensions to the previously mentioned first reference axis, and obtaining the distance values of the lower and upper generating lines 17 and 44 of all the seats 6–6$^{III}$ from the first longitudinal, reference axis, and the distances of the bottom surfaces of the recesses 10–10$^{VII}$ of the bucket type tappets 9–9$^{VII}$ from the first longitudinal, reference axis (block 47).

In the second checking station 20, camshaft 25 is positioned between the live center 22 and the dead center 23 (block 48) and rotated by motor 24 about its longitudinal geometrical axis until there is reached an angular position whereby a pair of cams 32 and 33, in phase, have their eccentric portion, or lobe, in a position that is diametrically opposite to the feelers 43 of an associated pair of fourth gauging heads 42 (block 49). This pair of gauging heads 42, with its feelers 43 thus contacting the surface of the base circles of the cams 32 and 33, sends to the storing, processing and display unit 16 signals responsive to the radial dimensions of the base circles.

At this angular position, the feelers 39 of the third gauging heads 38 contact the main journals 34–37 and the gauging heads 38 send to unit 16 associated signals responsive to the arrangement of the lower and upper generating lines 40 and 41 of these journals (block 50). The processings of these signals by unit 16 comprise the checking of the position of the cross-section centers of the end journals 34 and 37, in other terms the position of the axes of these journals at the associated cross-sections of measurement, and the definition of a second longitudinal, reference axis, passing through the formerly mentioned cross-section centers (block 51). Further simple processings enable to refer to the previously mentioned second longitudinal axis the arrangement of both the lower and upper generating lines 40 and 41 of all journals 34–37 and the arrangements of the base circles of the pair of cams 32 and 33 (block 51).

The steps described with reference to blocks 49, 50 and 51 are repeated again (block 52) at other three different angular positions of camshaft 25, each time by rotating camshaft 25 until there is reached an angular position at which a different pair of cams in phase 26, 27, 28, 29 and 30, 31 have their lobes in positions diametrally opposite to the feelers 43 of the associated fourth gauging heads 42 (block 49). At each position, there is defined a second longitudinal, reference axis and the arrangements (detected each time—block 50) of the generating lines of the main journals 34–37 and of the base circles of one of the pairs of cams in phase 26, 27, 28, 29 and 30, 31, respectively, are referred to this second axis (block 51). The four sequences of values processed at the different angular positions are memorized each time in unit 16 (block 51).

At each of the four angular positions taken by camshaft 25 (block 53), the values relating to the dimensions of seats 6–6$^{III}$ of the cylinder head 2 and the journals 34–37 of camshaft 25, that are referred to the first and second reference axis (blocks 47 and 51), respectively, are processed in unit 16 as hereinafter described, simulating an assembly of the camshaft 25 in the cylinder head 2 wherein these axes overlap so as to form a common single reference axis, and evaluating the possible reciprocal positions among journals 34–37 and seats 6–6$^{III}$.

At each seat/main journal pair (for example, pair 6/34), there are defined, respectively, an upper maximum deviation $Y^{34}_{Smax}$ and a lower maximum deviation $Y^{34}_{Imax}$ between the cross-section centers of journal 34 and its associated seat 6, by calculating the difference between the distances of the upper and lower generating lines 41, 44 and 40, 17, respectively (block 54).

The maximum deviation values $Y^{j}_{Smax}$ and $Y^{j}_{Imax}$ (j=34, . . . , 37) thus defined for each seat/main journal pair (6/34)—and at a specific angular position taken by camshaft 25 with respect to cylinder head 2—delimit a range wherein there is comprised a deviation value $Y^{j}$ (j=34, . . . , 37) among the cross-section centers of journal (34) and those of seat (6) of that pair, that represents the actual transversal position of journal (34) in seat (6); in other terms, the position in a transversal direction parallel to the direction of displacement of valves 3–3$^{III}$.

In order to calculate the formerly mentioned deviation $Y^j$ of journals 34–37 (blocks 55–59), for each of the four predetermined angular positions taken by camshaft 25 in the cylinder head 2, it is assumed that owing to the thrust of some of the springs 12 associated with valves $3–3^{VII}$, the upper generating line 41 of one of the journals 34–37 contacts the upper generating line 44 of the corresponding seat $6–6^{III}$. Consequently, the deviation value $Y^j$ of that journal coincides with that of the associated upper maximum deviation $Y^j_{Smax}$.

More specifically, assuming that camshaft 25 is mounted in the cylinder head 2 angularly positioned, as shown in FIG. 2, the lobes of the cams 32, 33 of one of the four pairs are angularly positioned in such a way so as to contact the bucket type tappets $9^{VI}–9^{VII}$ of the associated valves $3^{VI}–3^{VII}$ and apply a thrust for opening these valves. Under this condition, springs 12—associated with valves $3^{VI}–3^{VII}$—apply a force to cams 32, 33 and to the journal 37 positioned therebetween, that tends to oppose to the opening of the valves $3^{VI}–3^{VII}$ and is sufficient for urging journal 37 to contact the associated seat $6^{III}$ at the associated upper generating lines 41 and 44. Hence, it will be $Y^{37}=Y^{37}_{Smax}$.

The processing in unit 16 for calculating the deviations $Y^j$ (block 55) includes the attributing to the deviations that refer to the other seat/journal pairs of initial values comprised within the associated ranges delimited as already described (block 54), in particular, with reference to the previous example, (block 54) to deviations $Y^{34}$, $Y^{35}$, and $Y^{16}$. For each value attributed to the $Y^j$ deviations, there corresponds a position taken by camshaft 25 in cylinder head 2, as schematically shown in FIG. 3 by way of a broken line 70, with segments representing the portions comprised between the cross-section centers of the main journals 34–37. In substance, the deformations that camshaft 25 undergoes when it is mounted in the cylinder head 2 and takes different angular positions are concentrated—as schematically indicated by broken line 70—in the areas for supporting camshaft 25 in the cylinder head 2, in other terms the seats/journals pairs.

In order to calculate the values of the deviations $Y^j$ that best approximate the arrangement of camshaft 25 when mounted in cylinder head 2, it is assumed that camshaft 25 tends to position itself in such a way as to minimize the total amount of deformations that it undergoes, i.e. the condition in which the stored elastic energy has a minimum value.

The processings performed in unit 16 consist in evaluating (block 56) the elastic deformation energy of camshaft 25 at certain values $Y^j$, and modifying the values $Y^j$ (block 58) until there is reached a combination that corresponds to a total minimum value of this elastic energy (block 57). This condition of minimum elastic energy represents a unique balance configuration for camshaft 25.

The calculating of the elastic deformation energy of camshaft 25 and the determining of the combination of $Y^j$ values that make it minimum is achieved in a known way, hereinafter only cursorily described.

With reference to a cartesian axis x, parallel to the first longitudinal reference axis, the elastic deformation energy of camshaft 25 can be expressed according to the following mathematical formula:

$$E=k\int(d^2Y/dx^2)^2dx \quad (1)$$

Where:

the integral is extended to all the length I of camshaft 25 the proportionality constant k depends on the shape of camshaft 25 and on the elasticity modulus of the material used for its manufacture and $d^2Y/dx^2$ is the curvature of the line representing the elastic deformation of camshaft 25.

As a possible simplification, the trend of the elastic deformation line, along which the neutral axis of the camshaft 25 positions itself, can be approximated by the broken line 70 obtained by considering the deformations of the camshaft 25 concentrated at points corresponding to the main journals 34–37 and, in particular, to the intermediate journals 35 and 36 where the curvature assumes more significant values. Moreover, it is possible to express the curvature at each intermediate journal 35, 36 with respect to the adjacent journals, as a function of the deviations $Y^j$ of the journal taken into consideration and the deviations $Y^{j-1}$ and $Y^{j+1}$ of the adjacent journals, like $[Y^j-Y^{j-1}+Y^{j+1})/2]$.

On the basis of such approximations, a simplified mathematical expression representing the elastic energy is as follows:

$$E\cong k\Sigma^j[Y^j(Y^j-(Y^{j+1})/2]^2 \quad (2)$$

where j is only referred to the intermediate journals. Thus, the elastic energy stored by camshaft 25 mounted in cylinder head 2 can be formulated as:

$$E\cong k\{[Y^{35}-(Y^{34}+Y^{36})/2]^2+[Y^{36}-(Y^{35}+Y^{37})/2]^2\} \quad (3)$$

Assuming that camshaft 25 is mounted in the cylinder head 2 and arranged according to the angular position shown in FIG. 2, in other terms with the lobes of cams 26 and 27 at diametrically opposite positions with respect to the associated valves 3, $3^I$, it is also assumed, as previously mentioned, that the position of journal 37 is defined by the deviation value $Y^{37}=Y^{37}_{Smax}$, while initial values, comprised within the associated variability ranges, are attributed to the deviations of the other journals ($Y^{34}$,$Y^{35}$ and $Y^{36}$).

Subsequent processings in unit 16 include the calculation of the elastic energy variation, according to the mathematical formula (3), as the values $Y^{34}$, $Y^{35}$ and $Y^{36}$ vary, and the identifying of the specific tern of values that make the E value minimum. These processings involve, for example, the calculation of the partial derivatives of the formula (3) with respect to the deviations of each of the three journals, the increment (or decrement) of the value of one of the three deviations $Y^{34}$, $Y^{35}$ or $Y^{36}$ on the basis of the comparison between the calculated derivatives and the associated variability ranges, a subsequent further calculation of the derivatives, a subsequent new increment (or decrement) of a deviation value, and the repetition of these steps for minimizing the E value.

The procedure ends when it is no longer possible to proceed, in other terms, for example, when all the deviations have reached a value that is at the limits of their associated variability ranges, or when the elastic energy becomes null, or after a certain number of repetitions (for example 100), ensuring the required accuracy.

In this way there are determined the values of the deviations $Y^j$ for the single journals 34–37 that minimize the elastic energy, and among these the deviation value $Y^{34}$ correlated to the journal 34 that is positioned between the cams 26 and 27 that, according to the specific angular position, have lobes oppositely arranged with respect to valves $3–3^I$. Then, for each of the two cams 26 and 27 there is calculated the gap $G^{26}$ (and $G^{27}$) that, in the absence of adjustment shims 11 (and $11^I$), exists between the surface of the cam 26 (and 27), in correspondence with its associated base circle, and the bottom of the recess 10 (and 10$^{I}$) of the bucket type tappet 9 (and 9$^{I}$) of the associated valve 3 (and 3$^{I}$) as follows:

$$G^{26}=A^{10}+Y^{34}-B^{26}$$

where $A^{10}$ is the distance of recess 10 from the first longitudinal reference axis (block 47), and $B^{26}$ is the distance of the surface of cam 26, in correspondence with its base circle, from the second longitudinal reference axis (block 51). The thickness values $S^{11}$ of the adjustment shims 11 (and 11$^{I}$) to be inserted in each of the two recesses 10 (and 10$^{I}$) associated with cams 26 and 27 are obtained by subtracting from the calculated gap value $G^{26}$ (and $G^{27}$) the value of the nominal clearance $G^{nom}$ that it is desired be maintained between the adjustment shims 11 (and 11$^{I}$) and the base circles of the cams 26 and 27.

$$S^{11}=G^{26}-G^{nom}$$

The procedure described (with reference to blocks 54–59) is repeated (block 60) for the other three angular positions chosen by camshaft 25, and at each repetition there are calculated the distances and the thickness values of the shims intended to cooperate with one of the remaining pairs of cams in phase (28, 29, 30 31, 32 33), and, hence, the checking procedure ends (block 61).

Therefore, the herein described method makes it possible to foresee how the clearance among the main journals 24–37 and associated seats 6–6$^{III}$ will be distributed over each journal-seat pair and at each angular position taken by camshaft 25.

This possibility is extremely important for correctly calculating the clearance between each cam of the camshaft 25 and its associated valve 3–3$^{VII}$, as this calculation takes into account the transversal positioning of the main journals 34–37 in the seats of the cylinder head 2.

As described at the beginning of the description, the known methods for adjusting the clearance between the cams of a camshaft and the associated valves regard various procedures (for example, the insertion of shims between the end of each valve and the bucket type tappet, or the selection of appropriately thick bucket type tappets). Needless to say, this invention can also apply to similar methods, as in such cases too it is necessary to correctly calculate the distance between the base circles of the cams and the associated bucket type tappets (or other elements intended to displace with the valves), for defining the shims to be inserted (or, in any case, to be modified) appropriate for obtaining the required clearance values.

The method according to the invention has been described with specific reference to a timing system of an engine with four valves per cylinder. However, the method is particularly flexible and hence easily applicable to any timing system, regardless of the camshaft 25 configuration (number and axial and angular position of the cams on camshaft 25, etc.) and cylinder head 2 (number and axial and angular position of the valves 3–3$^{VII}$, etc.) undergoing the checking. Obviously, as the timing system configuration varies, there are changes, for example, in the number and the arrangement of the feelers, and/or the number of the angular positions taken by the camshaft in which dimensions are detected and processed, but the processings that are performed do not substantially change.

Furthermore, the method herein described avoids using empiric and not too accurate procedures for calculating the thickness of the shims (11–11$^{I}$) to be inserted in recesses 10–10$^{VII}$ of the bucket type tappets 9–9$^{VII}$ of valves 3–3$^{VII}$ and, consequently, it permits to reduce the number of out-of-tolerance parts and the processing time.

There can be foreseen variants with respect to what has been described hereinbefore, without departing from the objects and the scope of the invention.

For example, the detectings described with reference to the first checking station 1 can also be performed at two distinct checking stations. A first checking station, including gauging heads with pairs of feelers, measures the inside diameter of the seats 6–6$^{III}$ of the cylinder head 2, with the caps 5 still to be removed further to the machining of seats 6–6$^{III}$ by a suitable machine tool, while a second checking station with gauging heads and feelers detects the arrangement of the recesses 10–10$^{VII}$ of bucket type tappets 9–9$^{VII}$, and the arrangement of the lower generating lines 17 of seats 6–6$^{III}$ subsequently to the mounting of the cylinder head in the associated cylinder block and the removal of caps 5. It is possible to immediately determine, by processing in a simple way the diameter values and the values relating to the arrangement of the lower generating lines 17 of the seats 6–6$^{III}$, the arrangement of the upper generating lines 44 of the seats. According to this embodiment of the invention, it is possible to measure more easily the arrangement of the recesses 10–10$^{VII}$ of the bucket type tappets 9–9$^{VII}$ and keep into account, upon calculating the shims 11, 11$^{I}$, the deformations that the cylinder head 2 undergoes when it is mounted in the cylinder block.

The checking stations can include checking means that differ from those described (in a very schematic way), and comprise, for example, optical type heads, or heads of another type.

The storing, processing and display unit 16 can be connected to each checking station, or not be directly connected to the checking stations. Under this second circumstance, the data detected by each checking station are stored in a magnetic support that accompanies each element (cylinder head 2 and camshaft 25) along all the production line and contains the results of all the measurements taken. The data are thereafter entered—by means of a scanner—in the storing, processing and display unit 16, that performs the necessary processings.

In order to obtain the values of the deviations $Y^{j}$ that best approximate the arrangement of camshaft 25 once it is mounted in cylinder head 2, it is possible to follow a different principle with respect to the one herein described, based on the checking of a number of mechanical conditions in the coupling camshaft/cylinder head, but that in any case allows to foresee, at every angular position taken by the camshaft, the distribution of the clearance existing between the main journals 34–37 and the seats 6–6$^{III}$ over every single journal 34–37.

What is claimed is:

1. Method for the dimension checking of the timing system of an internal combustion engine comprising at least a camshaft (25) with cams (26–33) and main journals (34–37), and a cylinder head (2) with valves (3–3$^{VII}$) and seats (6–6$^{III}$) for housing the main journals (34–37) and defining the position of said camshaft (25) in a longitudinal direction, the method including the steps of detecting and processing (50,51) values relating to diametral dimensions of the main journals (34–37) of the camshaft (25) and radial dimensions of the cams (26–33), detecting and processing (46,47) values relating to diametral dimensions of the seats (6–6$^{III}$) of the cylinder head (2), and the transversal arrangement of the valves (3–3$^{VII}$) with respect to said longitudinal direction, and calculating (59)—on the basis of the detected values and in the course of the camshaft (25) rotation—a clearance value ($G^{26}$) between each cam (26–33) and its associated valve (3–3$^{VII}$), characterized by the further steps of calculating (54–58), on the basis of said detected values, the deviation values ($Y^j$) that represent the transversal position of each main journal (34–37) in its associated seat (6–6$^{III}$), and processing (59) the deviation values ($Y^j$) with said detected values for calculating said clearance value.

2. The method according to claim 1, for checking a timing system comprising bucket type tappets (9–9$^{VII}$) associated with the valves (3–3$^{VII}$), wherein the step of detecting and processing values relating to the transversal arrangement of the valves (3–3$^{VII}$) with respect to said longitudinal direction comprises detectings (46) relating to the transversal arrangement of the bucket type tappets (9–9$^{VII}$), and the step of calculating, in the course of the rotation of camshaft (25), a clearance value between each cam (26–33) and its associated valve (3–3$^{VII}$), comprises calculating (59) the clearance value ($G^{26}$) between each cam and a surface of the associated bucket type tappet (9–9$^{VII}$).

3. The method according to claim 1, wherein the steps of detecting and processing values relating to the diametral dimensions of said main journals (34–37) and said seats (6–6$^{III}$), respectively, comprise processings (47,51) of said values for defining a first and a second longitudinal reference axis, respectively, and referring the detected values to these axes.

4. The method according to claim 3, wherein the step of calculating the deviation values comprises processings (54) for defining, for each pair consisting of a main journal (34–37) and its associated seat (6–6$^{III}$), a range of values ($Y^j_{Imax}$–$Y^j_{Smax}$) within which said deviation is comprised.

5. The method according to claim 4, wherein said step of calculating said deviation values comprises the steps of evaluating (56) the elastic energy stored by said camshaft (25) at each of different angular positions (53) taken by said camshaft (25), and calculating (56–58)—for each of said different angular positions taken by camshaft (25)—the deviation values ($Y^j$) that correspond to a minimum value of stored elastic energy.

6. The method according to one of the preceding claims, wherein the steps of detecting and processing the values relating to the diametral dimensions of said main journals (34–37) and said seats (6–6$^{III}$), respectively, comprise the detecting of distances (46,50) relating to lower generating lines (40,17) and upper generating lines (41,44) of said journals and seats, respectively.

7. Apparatus for checking the timing system of an internal combustion engine according to the method described in claim 1, comprising a first checking station (1) with a structure (13) for supporting and referring said cylinder head (2) and first detecting devices for providing signals responsive to the arrangement of the internal surfaces of the seats (6–6$^{III}$) and to the transversal arrangement of the valves (3–3$^{VII}$), a second checking station (20) with support elements (22, 23) that define a longitudinal geometrical axis for supporting the camshaft (25) in different angular positions about said longitudinal geometrical axis and second detecting devices for providing, for each of said different angular positions taken by camshaft (25), signals responsive to the arrangement of the surfaces of the main journals (34–37), and to the radial dimensions of the base circles of the cams (26–33), and a memorizing, processing and display unit (16) for receiving and processing the signals of said first and second detecting devices.

8. A checking apparatus according to claim 7, wherein said first detecting devices comprise first gauging heads (14) for providing signals responsive to the arrangement of the internal surfaces of the seats (6–6$^{III}$) and second gauging heads (18) for providing signals responsive to the transversal arrangement of the valves (3–3$^{VII}$).

9. An apparatus according to claim 8, for checking a timing system comprising bucket type tappets (9–9$^{VII}$), wherein said second gauging heads (18) cooperate with surfaces of the bucket type tappets (9–9$^{VII}$) and provide signals responsive to the transversal arrangement of the bucket type tappets (9–9$^{VII}$).

10. A checking apparatus according to one of claims from 7 to 9, wherein said second detecting devices comprise third gauging heads (38) for providing, for each of said different angular positions taken by camshaft (25), signals responsive to the arrangement of the surfaces of the main journals (34–37), and fourth gauging heads (42) for providing—for each of said different angular positions taken by camshaft (25)—signals responsive to the radial dimensions of the base circles of the cams (26–33).

11. A checking apparatus according to claim 10, wherein said support elements of the second checking station (20) comprise a live center (22) and a dead center (23) that define said longitudinal geometrical axis.

12. An apparatus according to claim 11, wherein said second checking station (20) comprises a motor (24) coupled to said live center (22) for the rotation of the camshaft (25) about said longitudinal geometrical axis.

* * * * *